US008904577B2

(12) United States Patent
Osika

(10) Patent No.: US 8,904,577 B2
(45) **Date of Patent: *Dec. 9, 2014**

(54) APPARATUS FOR MOVING A LIMB OF A BEDRIDDEN PERSON

(71) Applicant: Michael P. Osika, Depew, NY (US)

(72) Inventor: Michael P. Osika, Depew, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/071,392

(22) Filed: Nov. 4, 2013

(65) Prior Publication Data

US 2014/0053334 A1 Feb. 27, 2014

Related U.S. Application Data

(63) Continuation-in-part of application No. 13/474,802, filed on May 18, 2012, now Pat. No. 8,572,774, and a continuation of application No. PCT/US2013/041678, filed on May 17, 2013, which is a continuation of application No. 13/474,802, filed on May 18, 2012, now Pat. No. 8,572,774.

(51) Int. Cl.

| | |
|---|---|
| ***A61H 1/02*** | (2006.01) |
| ***A61G 7/10*** | (2006.01) |
| *A61G 7/00* | (2006.01) |

(52) U.S. Cl.

CPC ..... *A61G 7/1082* (2013.01); *A61G 7/10* (2013.01); *A61H 1/02* (2013.01); *A61G 7/1009* (2013.01); *A61G 7/0005* (2013.01); *A61G 7/1015* (2013.01); *A61G 7/1044* (2013.01); *A61G 7/1096* (2013.01)

USPC ..... 5/83.1; 5/85.1; 5/89.1; 5/662; 601/24

(58) Field of Classification Search

CPC ..... A61G 7/1015

USPC ..... 5/612, 621, 624, 662, 81.1 R, 83.1, 648, 5/85.1, 87.1, 88.1, 89.1; 601/24, 33–35; 602/33–35; 482/95, 135, 143

See application file for complete search history.

(56) References Cited

U.S. PATENT DOCUMENTS

| | | | |
|---|---|---|---|
| 2,183,265 | A | 12/1939 | Maloney |
| 2,900,976 | A | 8/1959 | Kilmer |

(Continued)

FOREIGN PATENT DOCUMENTS

| | | |
|---|---|---|
| JP | 01262863 | 10/1989 |
| SU | 1694164 | 11/1991 |
| WO | 9312740 | 7/1993 |
| WO | WO 2013/173775 A1 * | 11/2013 |

OTHER PUBLICATIONS http://www.stackandstacks.com/e2-ceiling-mounted-trapeze-by-health-craft?id=172&sku=160587&REFID=MyBuys (last visited May 28, 2012).

*Primary Examiner* — Michael Trettel

(74) *Attorney, Agent, or Firm* — Simpson & Simpson, PLLC

(57) ABSTRACT

An apparatus for moving a limb of a bedridden person having a pulley secured above said bedridden person, a cable supported and arranged for movement about the pulley, and a substantially "T" shaped member consisting of a first longitudinally arranged member having a first end and a second end, where the first end is removably secured to the cable, and a second laterally arranged member secured transversely to the second end of the first member, where the first longitudinally arranged member is arranged perpendicularly to the second laterally arranged member.

11 Claims, 7 Drawing Sheets

(56) References Cited

U.S. PATENT DOCUMENTS

| | | | |
|---|---|---|---|
| 3,506,985 | A | 4/1970 | Lang |
| 3,597,774 | A | 8/1971 | Warren |
| 3,750,199 | A | 8/1973 | Spivey |
| 3,877,089 | A | 4/1975 | Spivey et al. |
| 4,005,498 | A | 2/1977 | Starr et al. |
| 4,390,015 | A | 6/1983 | Clements |
| 4,446,587 | A | 5/1984 | Jump |
| 4,489,713 | A | 12/1984 | Latenser |
| 4,571,758 | A | 2/1986 | Samuelsson |
| 4,627,119 | A | 12/1986 | Hachey et al. |
| 4,644,595 | A | 2/1987 | Daniel |
| 4,944,056 | A | 7/1990 | Schroeder et al. |
| 4,999,862 | A | 3/1991 | Hefty |
| 5,068,931 | A | 12/1991 | Smith |
| 5,095,562 | A | 3/1992 | Alexander |
| 5,123,131 | A | 6/1992 | Jandrakovic |
| 5,210,887 | A | 5/1993 | Kershaw |
| 5,235,712 | A | 8/1993 | Smith |
| 5,315,723 | A | 5/1994 | Smith |
| 5,333,333 | A | 8/1994 | Mah |
| 5,480,375 | A | 1/1996 | La Fosse et al. |
| 5,511,256 | A | 4/1996 | Capaldi |
| 5,694,654 | A | 12/1997 | Roy |
| 5,802,633 | A | 9/1998 | Capaldi |
| 5,809,591 | A | 9/1998 | Capaldi et al. |
| 5,815,859 | A | 10/1998 | Lavin |
| 5,946,748 | A | 9/1999 | Wang |
| 6,047,418 | A | 4/2000 | Seide et al. |
| 6,261,250 | B1 | 7/2001 | Phillips |
| 6,321,398 | B1 | 11/2001 | Wang |
| 6,772,456 | B2 | 8/2004 | Votel |
| 7,111,338 | B2 | 9/2006 | Faux et al. |
| 7,137,959 | B2 | 11/2006 | Phillips |
| 7,287,288 | B2 | 10/2007 | Walker |
| 7,350,247 | B2 | 4/2008 | Bogh-Sorensen |
| 7,578,012 | B2 | 8/2009 | Palay et al. |
| 7,669,255 | B2 | 3/2010 | Raney |
| 8,572,774 | B1 * | 11/2013 | Osika ..... 5/83.1 |
| 2011/0225728 | A1 | 9/2011 | Thornhill et al. |

* cited by examiner

APPARATUS FOR MOVING A LIMB OF A BEDRIDDEN PERSON

CROSS REFERENCE TO RELATED APPLICATIONS

This application claims priority under 35 U.S.C. §120 as a continuation-in-part of U.S. patent application Ser. No. 13/474,802, filed May 18, 2012 and issued as U.S. Pat. No. 8,572,774, which patent is incorporated herein by reference.

FIELD OF THE INVENTION

The invention relates to an apparatus for moving a limb of a bedridden person in order to facilitate a caregiver in bathing or changing the dressings of the person.

BACKGROUND OF THE INVENTION

There is a need to lift the legs of a bedridden person to bathe or clean the person, or to change dressings, a diaper, or apparel. Sometimes the bedridden person is disabled/paralyzed, or just lacks the leg strength to assist the caregiver. This problem has been recognized by others in the art, who have offered various solutions.

PCT Publication No. WO9312740 (Kawano) discloses a diaper replacing aid for bedridden people consisting of a leg holding portion 1, a pulling device 2 secured to the leg holding portion, arranged to pull a leg obliquely upwardly, and a support stand 3 for supporting the pulling device 2. The closed loop structure of the Kawano leg holding portion requires the caretaker to insert the patient's leg (or legs) into the loop, similar to threading the eye of a needle. This is somewhat cumbersome, especially if the person is unable to move his or her legs.

U.S. Pat. No. 5,123,131 (Jandrakovic) discloses a patient standing assistance apparatus having pulleys mounted to a ceiling, directing a cable connected to a harness which is arranged to wrap around a person to lift a person in the process of standing. Again, the harness in this invention forms a closed loop, with problems similar to the closed loop disclosed by Kawano supra.

PCT Publication No. SU1694164 (Kharchenko) discloses a hip joint mobility training device which includes a vibration unit having controls 10 and a strap loop 6 for positioning a single raised leg. A person stands while the device mobilizes the raised leg. Moreover, the loop in this invention is closed like the harness in the Jandrakovic patent. This procedure can also be cumbersome due to the fact that the person must be standing in order to use the invention. This patent neither teaches nor offers a solution to raising a limb of a bedridden person.

PCT Publication No. 01262863 (Hayakawa) discloses an apparatus for maintaining a lifted position for a bedridden person, having a pair of right and left supporting stands 1 which are operatively arranged along the right and left sides of the waist of a human body, a pair of right and left supporting columns 2 protruding upwards from the pair of right and left supporting stands 1, a pair of right and left bars 4 extending along the legs of a human body, and a rod 6 erected between the middle parts of the right and left bars 4 to support the under surface of the knees of a person. The patient is limited in his or her movement by the support structure, and may also be unable to use the invention if he or she does not fit between the stands.

U.S. Pat. No. 4,999,862 (Hefty) discloses a wheelchair mounted invalid lift having a wheelchair 1, a vertical support post 11, a cantilever beam 12, an outrigger 40 support to ensure stability of the wheel chair, lifting bar 22, and an attachable sling 23 to cradle and lift a patient. The cantilever beam 12 supports a lift motor 20, which is track mounted on the cantilever beam 12, and the lift motor 20 is connected to a lifting line 21 and a lifting bar 22. A sling 23 is attachable to lifting bar 22 to hold patients. The lift motor 20 can be operated to raise and lower the patient within the wheelchair 1. The lifting line 21 and lifting bar 22 appear to be shaped like a "T" bar however, the "T" shaped assembly disclosed in this reference consists of a line and a bar secured transversely to the line. A caregiver would not place the lifting line 21 and lifting bar 22 between a patient's legs because the lifting line 21 could scratch, cut, or maim a patient. This patent neither teaches nor offers a solution for moving the legs of a bedridden person.

Therefore, there is a long-felt need for an apparatus for moving the limb of a bedridden person. There is also a long-felt need for an apparatus for moving the limb of a bedridden person that is easily positionable and less expensive to manufacture. Furthermore, there is a long-felt need for an apparatus for moving the limb of a bedridden person that has a "T" shaped member.

BRIEF SUMMARY OF THE INVENTION

The present invention is an apparatus for moving a limb of a bedridden person having a pulley secured above said bedridden person, a cable supported and arranged for movement about the pulley, and a substantially "T" shaped member consisting of a first longitudinally arranged member having a first end and a second end, where the first end is removably secured to the cable, and a second laterally arranged member secured transversely to the second end of the first member, where the first longitudinally arranged member is arranged perpendicularly to the second laterally arranged member.

A general object of the present invention is to provide an apparatus for moving the limb of a bedridden person.

Another object of the present invention is to provide an apparatus for moving the limb of a bedridden person that is easily positionable.

Yet another object of the present invention is to provide an apparatus for moving the limbs of a bedridden person that is less expensive to manufacture.

Still another object of the present invention is to provide an apparatus for moving the limb of a bedridden person that has a "T" shaped member and a pulley.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspect. The present invention is intended to include various modifications and equivalent arrangements within the spirit and scope of the appended claims.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. The term substantially "T" shaped used herein refers to the general shape of first member 25 and transverse member 24 of the invention and is meant to include linear members and nonlinear members. For example, first member 25 and transverse member 24 could each assume a variety of shapes including curves, parabolas, and angles while maintaining a substantially "T" shape. Although any methods, devices or materials similar or equivalent to those described herein can be used in the practice or testing of the invention, the preferred methods, devices, and materials are now described.

Structure

Figure 1:
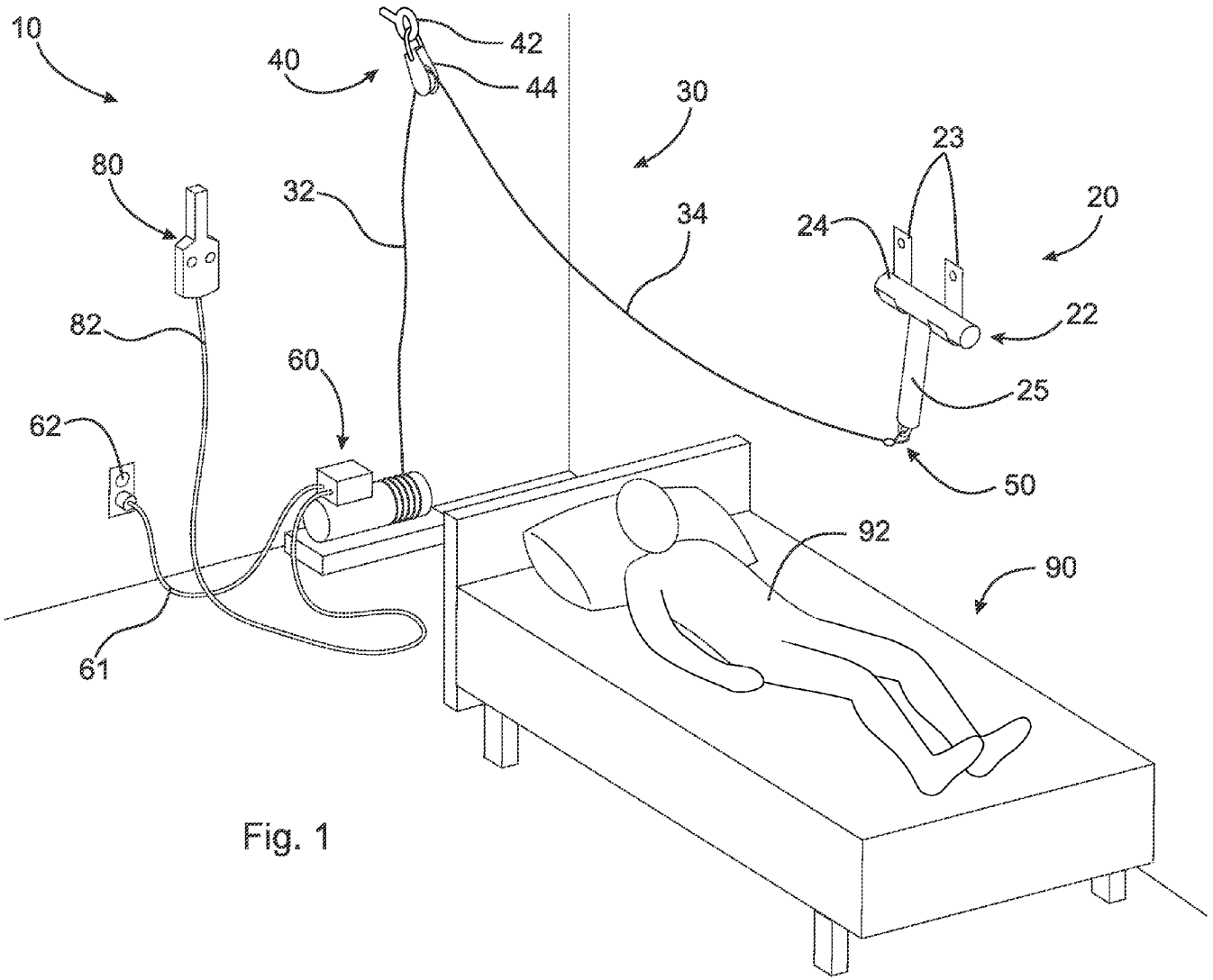
FIG. 1 is a perspective view of the apparatus for moving a limb of a bedridden person of the invention shown as the "T" shaped member is hung on a wall.

Adverting now to the figures, FIG. 1 is a perspective view of apparatus 10 for moving a limb of a bedridden person 92. Apparatus 10 comprises, in a preferred embodiment, "T" shaped member 22, pulley 44, and cable 30. FIG. 1 shows "T" bar assembly 20 comprising "T" shaped member 22, first member 25, and transverse member 24. "T" shaped member 22 is depicted hanging from wall-mounted brackets 23. First member 25 is shown substantially upright and transverse member 24 is shown secured transversely to first member 25. It should be appreciated that, as pictured here, "T" shaped member 22 is not clamped or otherwise secured to the wall. Thus, it should be appreciated that "T" shaped member 22 could be stored without wall-mounted brackets 23. For example, "T" bar assembly 20 could be stored under bed 90. Additionally, it should be appreciated that because "T" bar assembly 20 has no clamping or other secure means and instead stores freely a user of the present invention can quickly and easily position and store apparatus 10.

Connection 50 (discussed in more detail below) and cable 30 are shown at the bottom of first member 25 of FIG. 1. Cable 30 comprises transverse portion 34 and vertical portion 32 and transverse portion 34 is shown joining connection 50 and wall mounted pulley assembly 40. Vertical portion 32 is depicted connecting wall mounted pulley assembly 40 and motorized winch 60. It should be appreciated that cable 30 can be any length to accommodate rooms of any size. Additionally, it should be appreciated that cable 30 is made of two or more wires running side by side and bonded, twisted, or braided together to form a single assembly. However, cable 30 could also comprise any suitable rope, wire, line, or chain that can accommodate the weight of the limbs of a person and be supported by pulley 44.

FIG. 1 further shows pulley 44 supporting cable 30. Pulley 44 and threaded eyelet 42 are together referred to as wall mounted pulley assembly 40. Pulley 44 is secured to threaded eyelet 42 which is, in turn, in a preferred embodiment, secured to a wall above bed 90. It should be appreciated that threaded eyelet 42 could be secured to a ceiling, a window, or any other fixture above bed 90. Moreover, it should be appreciated that threaded eyelet 42 could be supplemented with any suitable alternative. Wall mounted pulley assembly 40 could also be replaced with any suitable alternative such as a swivel hook block with latch made by Campbell, UPC Code 020418115004, available from Apex Tool Group, LLC located at 14600 York Rd, Suite A, Sparks, Md. 21152. Pulley 44 could also be fixed.

Finally, apparatus 10 is shown in FIG. 1 comprising motorized winch 60 connected to vertical portion 32. In a preferred embodiment, motorized winch 60 is a 120 volt, single phase, AC electric motor having an output of ¾ horse power (HP) and a maximum rated capacity of 1500 pounds. Additionally, in a preferred embodiment, motorized winch 60 operates at 60 cycles per second (Hz). Motorized winch 60, in the preferred embodiment, is made by Chicago Electric, SKU 96127, available from Harbor Freight Tools located at 3491 Mission Oaks Blvd., Camarillo, Calif. 93011-5034 and includes a 2 button forward/reverse remote control, a tethered remote control with 116' cable and a 35 ft. long cable assembly with drop-forged sling hook. It should be appreciated that DC motors could perform the same function or any electrical motor arranged to raise or lower "T" shaped member 22. Moreover, it should be appreciated that a manual substitute like a crank could be used instead (discussed below). Motorized winch 60 is shown in FIG. 1 connected to power cord 61 and power source 62 but, it should be appreciated that apparatus 10 could be powered with any suitable power source such as, a battery.

FIG. 1 further depicts hand held control 80 and remote control cord 82 which represent the 2 button forward/reverse remote control and cable available online with motorized winch 60 discussed above. Hand held control 80 provides a controlled rate of ascent and descent for "T" shaped member 22. For example, in order to raise "T" shaped member 22, a caregiver activates motorized winch 60 and presses the forward button of hand held control 80 and holds down the button until "T" shaped member 22 is appropriately raised. Then, when "T" shaped member 22 is appropriately raised, the caregiver releases the forward button of hand held control 80 and "T" shaped member 22 stops rising and locks in place. "T" shaped member 22 does not lower until a caregiver presses the reverse button of hand held control 80. A caregiver must hold the reverse button of hand held control 80 to lower "T" shaped member 22 so that "T" shaped member 22 doesn't fall freely and potentially injure the bedridden person.

Figure 2:
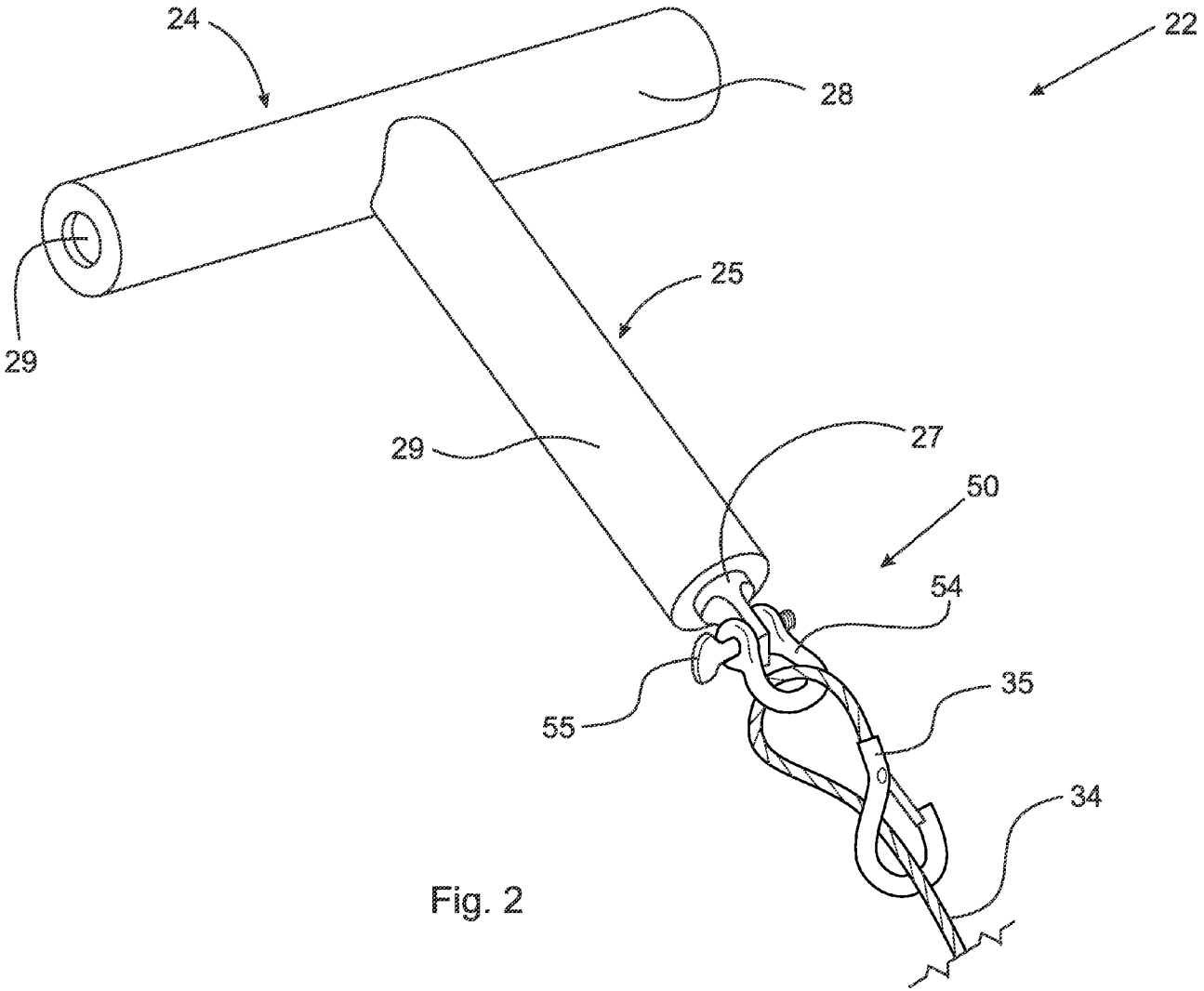
FIG. 2 is a perspective view of the "T" shaped member connectively secured to a cable of the invention.

FIG. 2 is a perspective view of "T" shaped member 22 of apparatus 10 and connection 50. FIG. 2 shows "T" shaped member 22 comprising transverse member 24, first member 25, connection 50 and transverse portion 34. In the preferred embodiment shown, transverse member 24 further comprises transverse foam covering 28, and first member 25 further comprises foam covering 29. Additionally, "T" shaped member 22 comprises first member bar 27. First member bar 27 is shown protruding outwardly and downwardly from first member 25 and first member foam covering 29. First member bar 27 is secured to clevis 54 by clevis screw 55. Transverse portion 34 of cable 30 is shown threaded through clevis 54. Additionally, transverse portion 34 is shown comprising snap hook 35. Transverse portion 34 remains operatively arranged threaded through clevis 54 because snap hook 35 hooks onto transverse portion 34 at a point on the other side of clevis 54. It should be appreciated that clevis 54 and clevis screw 55 could be substituted with any suitable clamping means such as, a screw pin anchor shackle (Part #: SPAS3/8SS) available from U.S. Cargo Control located at 202 Blue Creek Drive, Urbana, Iowa 52345.

First member foam covering 29 is cylindrical but, it should be appreciated that foam covering 29 could take any shape. Similarly, it should be appreciated that transverse foam covering 28 could be any shape. In the preferred embodiment shown, transverse foam covering 28 is also cylindrical. It is envisioned that transverse foam covering 28 and first member foam covering 29 are substantially made of polystyrene foam but, it should be appreciated to a person having ordinary skill in the art that the covering could be made of any appropriate substitute such as paper, paperboard, corrugated cardboards, biodegradable plastic, or cloth or natural fibers like cotton, wool, or hemp. A person having ordinary skill in the art could cover transverse member 24 and first member 25 with any suitable material having a tubular shape or one could cover transverse member 24 and first member 25 by wrapping and securing any suitable material having any suitable shape around transverse member 24 and first member 25. The coverings described and illustrated herein help minimize the possibility that a bedridden person is injured or scratched by apparatus 10.

Figure 3:
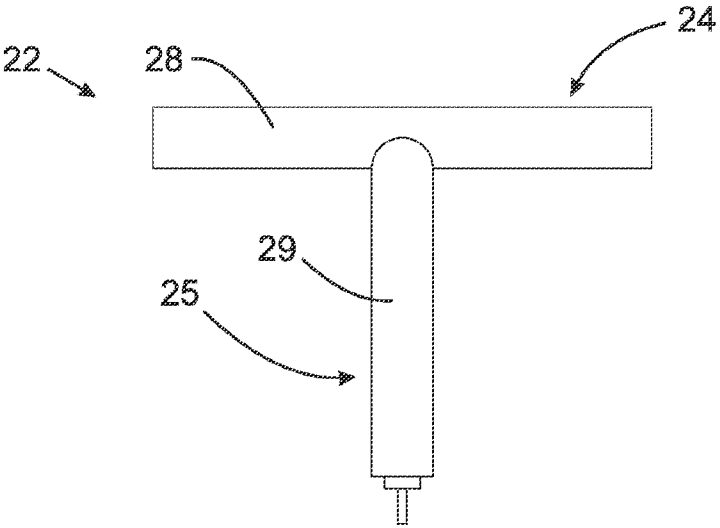
FIG. 3 is a top plan view of the "T" shaped member of the invention.

FIG. 3 is a top plan view of "T" shaped member 22 of apparatus 10 showing first member 25 arranged substantially upright and transverse member 24 secured transversely to the upper end of first member 25.

Figure 4:
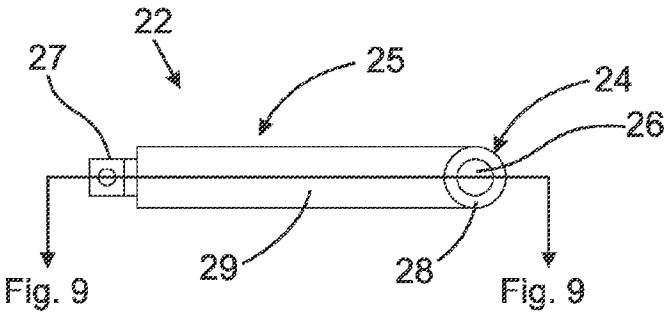
FIG. 4 is a side partial cross-sectional view of the "T" shaped member of the invention arranged horizontally depicting the inside of the transverse member.

FIG. 4 is a side partial cross-sectional view of "T" shaped member 22 of apparatus 10 depicting transverse member 24 and first member 25. From this perspective, transverse member 24 is shown comprising transverse bar 26 and transverse foam covering 28. Transverse member 24 and transverse foam covering 28 are cylindrical and transverse foam covering 28 is shown wrapped around transverse bar 26. Additionally, FIG. 4 shows first member 25 comprising first member bar 27 and first member foam covering 29 where first member foam covering 29 enclosing first member bar 27. First member bar 27 is shown protruding leftwardly from first member foam covering 29.

Figure 5:
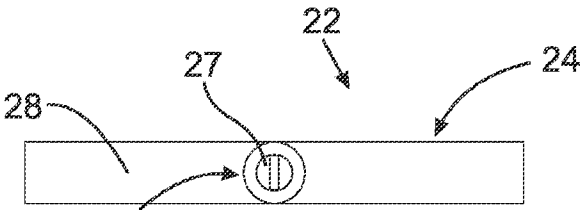
FIG. 5 is a front elevational view of the "T" shaped member showing the end of the first member of the invention.

FIG. 5 is a front elevational view of "T" shaped member 22 showing the first end of first member 25 of apparatus 10. FIG. 5 shows first member bar 27 surrounded by first member 25. Transverse member foam covering 28 is shown covering transverse member 24.

Figure 6:
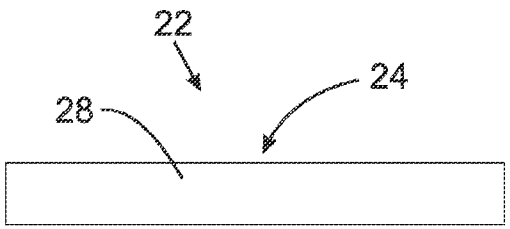
FIG. 6 is a back elevational view of the "T" shaped member of the invention showing only the transverse member of the invention.

FIG. 6 is a back elevational view of "T" shaped member 22 of apparatus 10 showing only transverse member 24 of the invention and transverse foam covering 28 fully covering transverse member 24.

Figure 7:
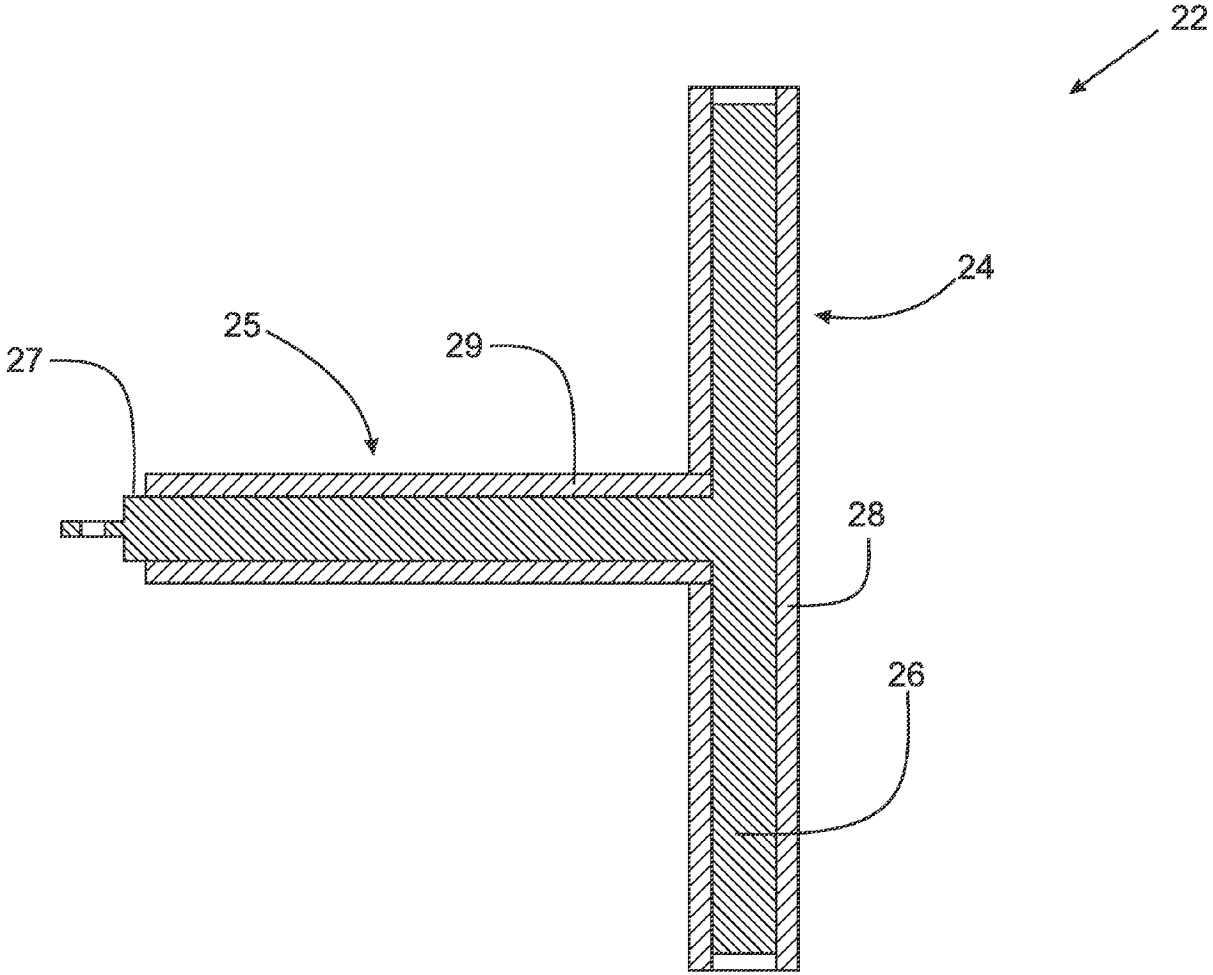
FIG. 7 is a cross-sectional view of the "T" shaped member taken generally along line 9-9 in FIG. 4.

FIG. 7 is a cross-sectional view of "T" shaped member 22 taken generally along line 9-9 in FIG. 4. Transverse bar 26 is shown inside transverse member foam covering 28. First member bar 27 is shown inside first member foam covering 29 and protruding leftwardly from within first member foam covering 29. It should be appreciated that transverse bar 26 and first member bar 27 can be made from a single piece of material or they could be made separately and secured to one another.

Figure 10:
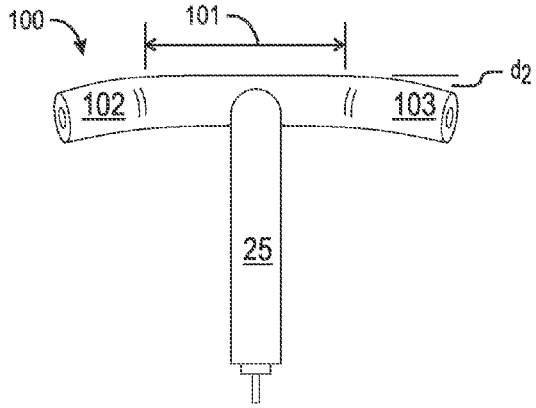
FIG. 10 is a top plan view of an alternate embodiment of the "T" shaped member of the invention.

An alternate embodiment of "T" shaped member 22 is shown in FIG. 10. Transverse member 100 comprises linear portion 101 and first and second curved portions 102 and 103. Linear portion 101 is flat and perpendicular to first member 25. First curved portion 102 and second curved portion 103 are curved.

Figure 11:
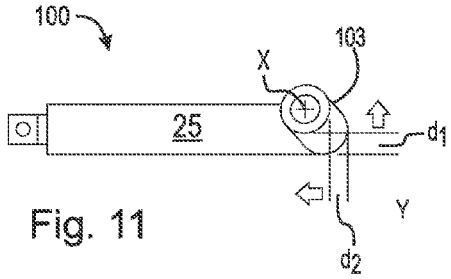
FIG. 11 is a side view of an alternate embodiment of the "T" shaped member of the invention arranged horizontally.

As shown in FIG. 11, second curved portion 103 is elevated above linear portion 101 and first member 25. First curved portion 102 is not visible behind second curved portion however, it should be appreciated that first curved portion 102 is substantially similar to second curved portion 103. Center X of second curved portion 103 is shifted distance $d_1$ in an upward direction from Y. It should be appreciated that distance $d_1$ could be increased or decreased to effectuate steeper curved portions 102 and 103. Additionally, center X of second curved portion 103 is shifted distance $d_2$ in a leftward direction from Y. Again, distance $d_2$ could be increased or decreased to effectuate a more pronounced curve. As shown in FIG. 10, curved portions 102 and 103 are moved distance $d_2$.

Figure 12:
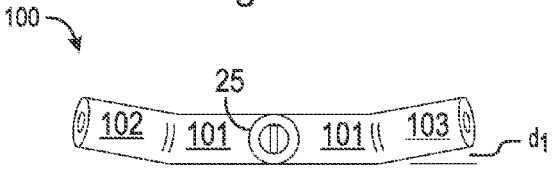
FIG. 12 is a front elevational view of an alternate embodiment of the "T" shaped member showing the first end of the first member and the curved ends of the transverse member of the invention.

FIG. 12 shows first and second curved portions 102 and 103 and distance $d_1$ of first and second curved portions 102 and 103.

Figure 13:
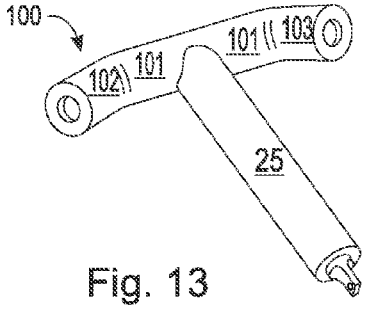
FIG. 13 is a perspective view of an alternate embodiment of the "T" shaped member of the invention.

FIG. 13 shows a perspective of "T" shaped member 22 including transverse member 100. It should be appreciated that first and second curved portions 102 and 103 could be shifted only along direction $d_1$ or only along direction $d_2$. Additionally, it should be appreciated that first and second curved portions 102 and 103 could be angled rather than curved to accommodate and stabilize a person's legs.

Figure 14:
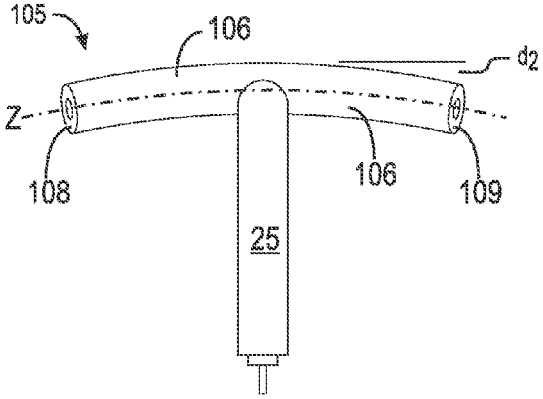
FIG. 14 is a top plan view of a further embodiment of the "T" shaped member of the invention.
Figure 15:
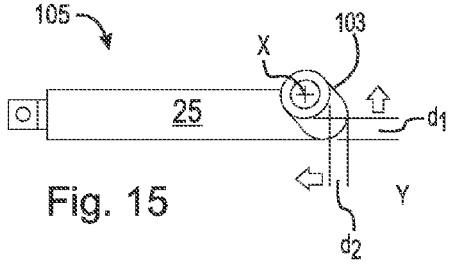
FIG. 15 is a side view of a further embodiment of the "T" shaped member of the invention arranged horizontally.

A further embodiment of "T" shaped member 22 is shown in FIG. 14. Transverse member 105 comprises curved portion 106. Curved portion 106 has ends 108 and 109 which are connected along a continuous curved line Z. FIG. 15 shows end 109 of curved portion 106. End 108 is not visible behind end 109. Ends 108 and 109 of curved portion 106 are disposed away from Y distances $d_1$ and $d_2$. As discussed above, curved portion 106 can be further accentuated by increasing $d_1$ and/or $d_2$. Alternatively, curved portion 106 can be straightened be decreasing $d_1$ and/or $d_2$. FIG. 14 shows ends 108 and 109 of curved portion 106 shifted along distance $d_2$.

Figure 16:
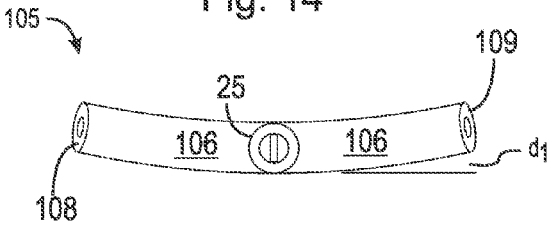
FIG. 16 is a front elevational view of a further embodiment of the "T" shaped member showing the first end of the first member of the invention; and, FIG. 17 is a perspective view of a further embodiment of the "T" shaped member of the invention.
Figure 17:
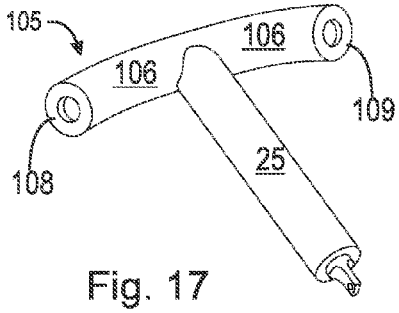

Curved portion 106 is shown in FIGS. 16 and 17. In FIG. 16, ends 108 and 109 are shown shifted along distance $d_1$. It should be appreciated that curved portion 106 could be "U" shaped or "V" shaped or any other suitable curved or angled surface to accommodate and stabilize a person's legs. Transverse members 100 and 105 could be curved or angled in any suitable manner to accommodate and stabilize a person's legs.

Function

Figure 8:
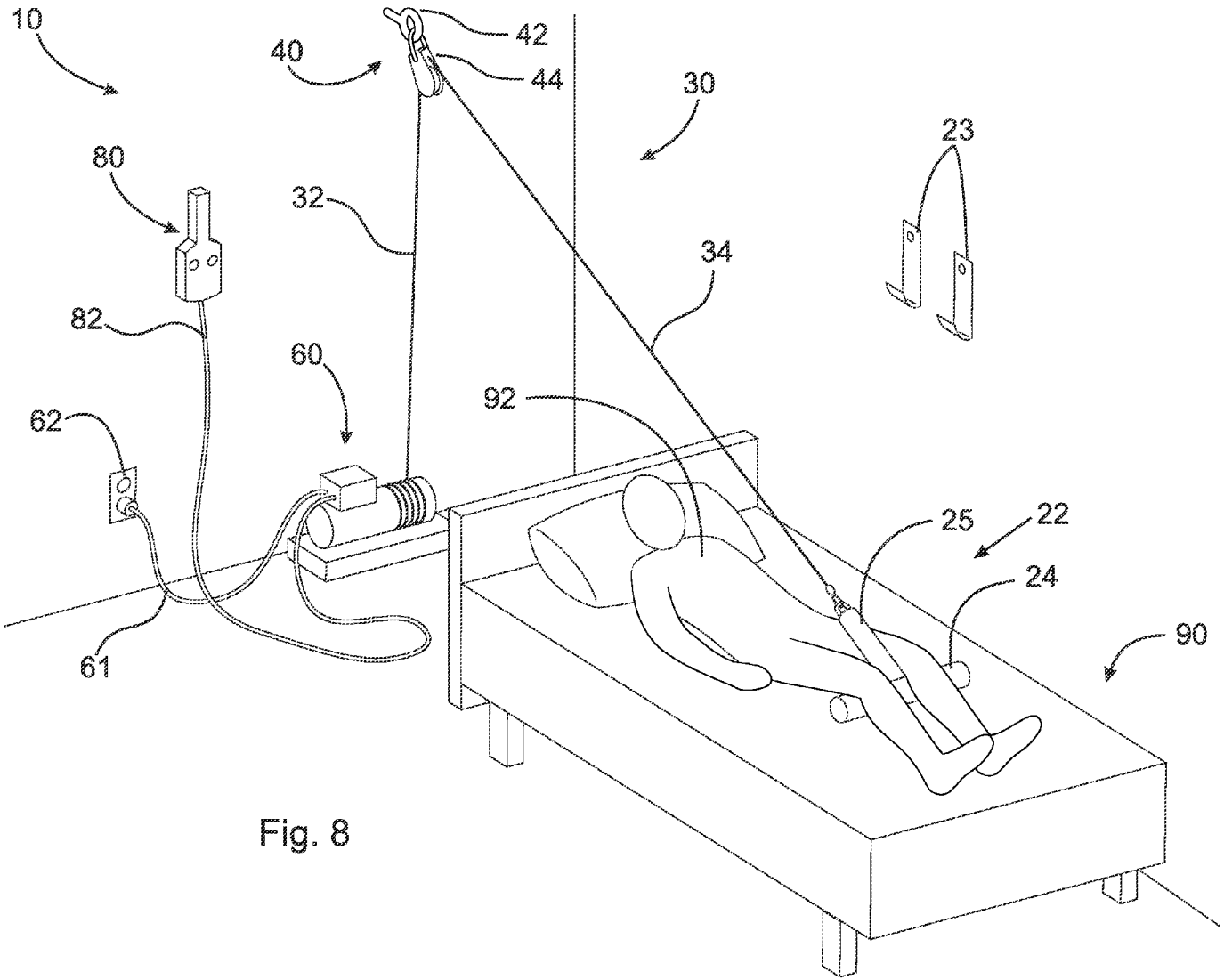
FIG. 8 is a perspective view of the apparatus for moving a limb of a bedridden person showing the invention in use with the "T" shaped member disposed under a person's knees while the person lays on his or her back.

FIG. 8 is a perspective view of apparatus 10 for moving a limb of a bedridden person at rest 92 showing "T" shaped member 22 arranged under the knees of person at rest 92 laying atop bed 90. In order to position "T" shaped member 22 under the knees of person at rest 92, a caretaker first orients "T" shaped member 22 such that first member 25 is longitudinally arranged parallel to and above person at rest 92; transverse member 24 is perpendicular to the person at rest 92 and substantially horizontal. In this arrangement, first member 25 is pointing towards the head of the person at rest 92. Once "T" shaped member 22 is arranged in this way, a caretaker can place "T" shaped member 22 under the knees of person at rest 92 in a number of ways. A caregiver can spread the legs of person at rest 92, place "T" shaped member 22 between the knees of a person at rest 92, and then position the person's legs on top of transverse member 24 on either side of first member 25. The openness of "T" shaped member 22 provides a simple and straightforward way for a caregiver to place "T" shaped member 22 under the knees of person at rest 92.

Sometimes it can be burdensome or painful to spread the legs of person at rest 92 so there are other ways to place "T" shaped member 22 under the knees of person at rest 92 without spreading legs. A caregiver can pull "T" shaped member 22 towards the foot of bed 90 so that a substantial amount of "T" shaped member 22 is suspended in the air proximate to the bottom of the feet of person at rest 92. Then a caregiver can slide "T" shaped member 22 (specifically transverse member 24) under the ankles of person at rest 92, under the calves of person at rest 92, and toward the person's knees until "T" shaped member 22 is positioned comfortably under the knees of person at rest 92.

Still another way that a caregiver can arrange "T" shaped member 22 under the knees of a person at rest 92 involves pivoting "T" shaped member 22. Again a caregiver first orients the "T" shaped member 22 so that first member 25 is parallel to person at rest 92 and transverse member 24 is perpendicular to person at rest 92. In this arrangement, transverse member 24 is substantially horizontal and suspended in the air proximate to the knees of person at rest 92. Instead of pulling "T" shaped member 22 towards the feet of person at rest 92 as described above, a caregiver rotates transverse member 24 substantially 90 degrees around first member 25. When transverse member 24 is rotated substantially 90 degrees around first member 25, transverse member 24 is still perpendicular to person at rest 92 but, it is now substantially vertical. From this substantially vertical arrangement, a caregiver can then arrange "T" shaped member 22 between the legs of person at rest 92 such that first member 25 is perpendicular to and protruding upwards from bed 90 and transverse member 24 is lying in line proximate with the legs of person at rest 92 and atop bed 90. Once "T" shaped member 22 is between the legs of person at rest 92, a caregiver can then rotate "T" shaped member 22 again to position transverse member 24 under the knees of person at rest 92. It should be understood that transverse member 24 can be rotated in either direction when a caregiver is positioning "T" shaped member 22 under the knees of person at rest 92 by rotation. When placing the ends of transverse member 24 under the knees of person at rest 92, it should be appreciated that a caregiver need only maneuver the legs of the person at rest 92 to the extent necessary to place transverse member 24 comfortably under the knees of person at rest 92. Furthermore, it should be appreciated that after "T" shaped member 22 is placed under the knees of a person at rest 92 by sliding means, rotation means, or any other means, the legs of person at rest 92 remain in an at rest position. Additionally, as shown in FIG. 8, when "T" shaped member 22 is properly positioned cable 30 is fully-extended.

Figures 9, 9A:
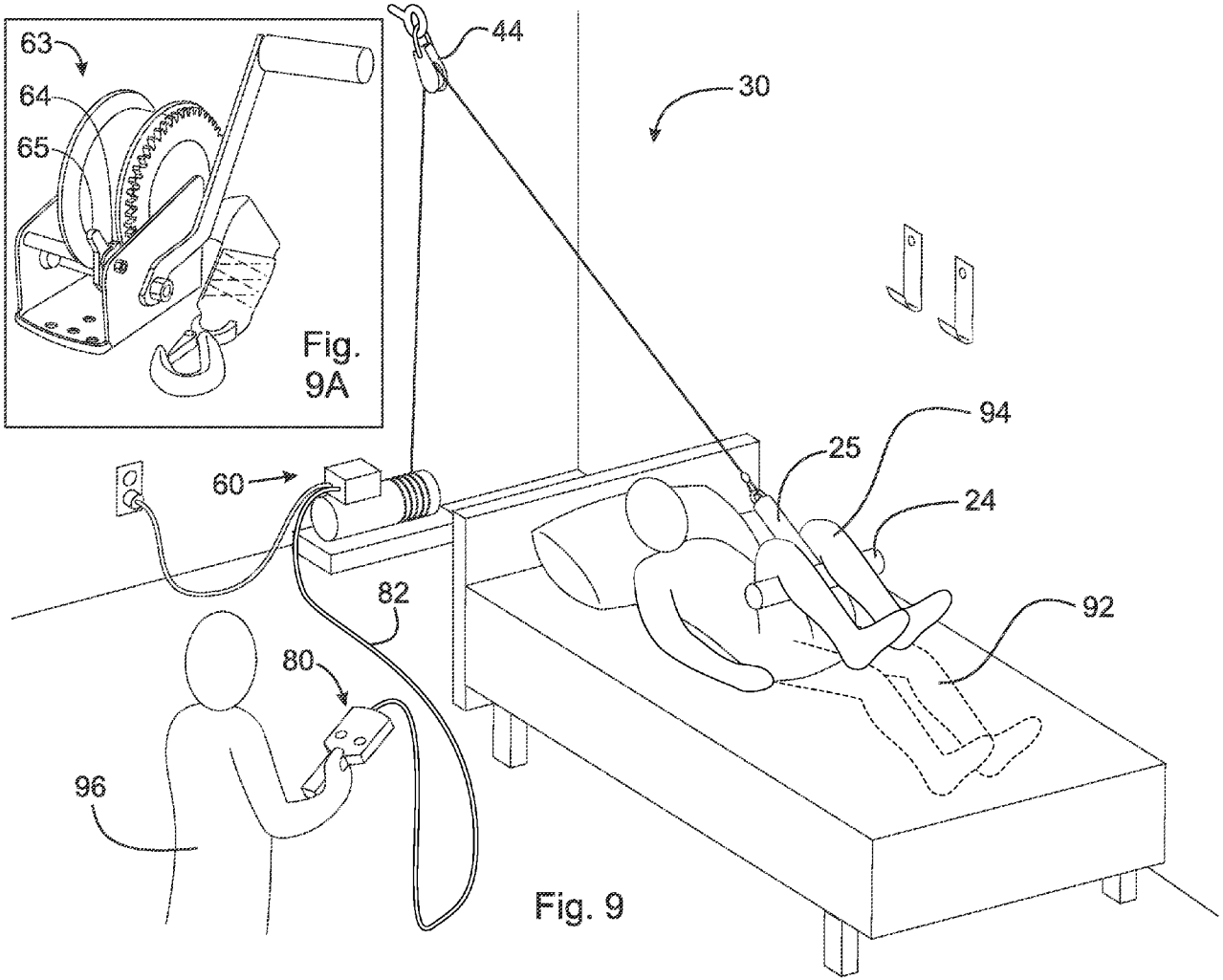
FIG. 9 is a perspective view of the present invention showing an aide using a winch to raise the "T" shaped member disposed under a person's knees such that the person's limbs are lifted from the surface of the bed.
FIG. 9A is a perspective view of an alternate embodiment of the present invention showing a hand cranked gearing mechanism.

FIG. 9 is a perspective view of apparatus 10 where aide 96 is depicted operating motorized winch 60 and raising "T" shaped member 22 to move the legs of person at rest 92. In this perspective, "T" shaped member 22 has already been placed under the knees of the person at rest 92. In order to lift the limbs of person at rest 92 so that a caregiver can clean, change, or dress the person, aide 96 activates motorized winch 60 to raise "T" shaped member 22 toward the ceiling. As "T" shaped member approaches the ceiling, person at rest 92 becomes person with legs raised 94 because "T" shaped member 22 has raised the person's knees upward from bed 90 toward the head of the person.

FIG. 9A is a perspective view of an alternate embodiment of apparatus 10 showing hand cranked gearing mechanism 63. As discussed above, it should be appreciated that apparatus 10 does not need motorized winch 60 to raise "T" shaped member 22. Instead, apparatus 10 can comprise any device that produces reciprocal linear motion. For example, apparatus 10 could comprise a manual rotating shaft like hand cranked gearing mechanism 63 whereby a person manually rotates a bent portion of the shaft or a separate arm attached to the shaft thereby converting circular motion into reciprocal linear motion through the shaft. In this alternate embodiment, hand cranked gearing mechanism 63 comprises disc brake system 64 and release 65. Disc brake system 64 self-activates and holds the load in place when the hand crank is released. In order for a caregiver to lower "T" shaped member 22, the caregiver must press release 65 and simultaneously rotate the hand crank in the reverse direction. Disc brake system 64 and release 65 operate as an equivalent to hand held remote 80. Disc brake system 64 and release 65 ensure that "T" shaped member 22 has a controlled descent so that a bedridden person is not injured by a free falling "T" shaped member 22. A similarly functioning winch having a strap can be purchased at Lowes located at 1000 Lowes Blvd., Mooresville, N. C. 28117 (product no. 184439, Reese Towpower Winch 1500 pound capacity with 20 ft. strap and hook, model no. 74329).

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What I claim is:

1. An apparatus for moving a limb of a bedridden person, comprising:

a pulley secured above said bedridden person;

a cable supported and arranged for movement about said pulley; and, a substantially "T" shaped member consisting of:

a first longitudinally arranged member having a first end and a second end, wherein said first end is removably secured to said cable, and a second laterally arranged non-linear member secured substantially transversely to said second end of said first member, wherein said first longitudinally arranged member is arranged substantially perpendicularly to said second laterally arranged member.

2. The apparatus for moving a limb of a bedridden person recited in claim 1, further comprising a motor operatively arranged to move said cable about said pulley.

3. The apparatus for moving a limb of a bedridden person recited in claim 1, further comprising a hand crank and a gearing mechanism to operate said pulley.

4. The apparatus for moving a limb of a bedridden person recited in claim 1, wherein said pulley is secured to a ceiling.

5. The apparatus for moving a limb of a bedridden person recited in claim 1, wherein said pulley is secured to a bed-frame.

6. The apparatus for moving a limb of a bedridden person recited in claim 1, wherein said cable comprises a means for securing said first end of said first member to said cable and said means comprises a swivel hook.

7. The apparatus for moving a limb of a bedridden person recited in claim 1, wherein said first member and said second member are cylindrical.

8. The apparatus for moving a limb of a bedridden person recited in claim 1, wherein said first member and said second member are enclosed within polystyrene foam wrap.

9. The apparatus for moving a limb of a bedridden person recited in claim 1, wherein said pulley is fixed.

10. The apparatus for moving a limb of a bedridden person recited in claim 1, wherein said second member is offset in relation to said first member in a first direction and/or a second direction.

11. The apparatus for moving a limb of a bedridden person recited in claim 1, wherein said second member is arcuate in relation to said first member.

* * * * *

UNITED STATES PATENT AND TRADEMARK OFFICE

CERTIFICATE OF CORRECTION

PATENT NO. : 8,904,577 B2
APPLICATION NO. : 14/071392
DATED : December 9, 2014
INVENTOR(S) : Michael P. Osika It is certified that error appears in the above-identified patent and that said Letters Patent is hereby corrected as shown below:

Title Page:

In the Related U.S. Application Data section on the Title Page, item (63), Col. 1, lines 4-7, "which is a continuation of application No. 13/474,802, filed on May 18, 2012, now Pat. No. 8,572,774" should read --which is a continuation-in-part of application No. 13/474,802, filed on May 18, 2012, now Pat. No. 8,572,774--.

Signed and Sealed this
Nineteenth Day of May, 2015

Michelle K. Lee

Michelle K. Lee
*Director of the United States Patent and Trademark Office*